United States Patent [19]

Lane

[11] Patent Number: 4,730,828

[45] Date of Patent: Mar. 15, 1988

[54] BODY STRENGTH AND CONDITIONING FRAME STRUCTURE

[75] Inventor: Mark R. Lane, Jefferson, Iowa

[73] Assignee: American Sports International, Ltd., Jefferson, Iowa

[21] Appl. No.: 2,516

[22] Filed: Jan. 12, 1987

[51] Int. Cl.[4] ..... A63B 21/06

[52] U.S. Cl. ..... 272/118; 272/143; 272/134

[58] Field of Search ..... 272/117, 118, 134, 143, 272/142, 73, 130, 135, 116

[56] References Cited

U.S. PATENT DOCUMENTS

| | | | |
|---|---|---|---|
| 3,524,644 | 8/1970 | Kane | 272/142 X |
| 3,746,337 | 7/1973 | Riecke, Jr. et al. | 272/118 |
| 4,068,843 | 1/1978 | Frost | 272/118 |
| 4,441,706 | 4/1984 | Korianiewski | 272/118 |
| 4,470,596 | 9/1984 | Desiderio | 272/118 |
| 4,673,177 | 6/1987 | Szymski | 272/73 |

*Primary Examiner*—Richard J. Apley

*Assistant Examiner*—J. Welsh

*Attorney, Agent, or Firm*—Zarley, McKee, Thomte, Voorhees & Sease

[57] ABSTRACT

A weight exercising machine especially adapted for variations in height, stature, and strength of persons using the machine. The apparatus consists of a frame containing a base and upright members to which a horizontal bar secures the upright members at the top, and a T-shape member slidingly attached to the upright members and telescopingly fitted over a center post which is secure to the base. Extending outward from the post and from the T-shaped member are horizontal rods which are in axial alignment with one another and onto which weights may be placed. When the horizontal rods are spaced a distance apart from each other which is less than the width of a weight members, the weight members may be so moved from one rod to the other. The apparatus may also include gripping devices for use in pulling the weights which consist of U-shaped members forming an upper bar for taller persons, and a lower bar for use by persons of similar stature.

18 Claims, 8 Drawing Figures

BODY STRENGTH AND CONDITIONING FRAME STRUCTURE

BACKGROUND OF THE INVENTION

Most body strength and conditioning equipment on the market today, and throughout the years, has been designed for adults, and principally for adult athletes. This equipment is generally heavy in construction and is not easily used by children or adults of slight stature. Further, loading this equipment with a variety of weights is often difficult, if not dangerous, and is not easily accomplished by children. In fact, much of such equipment is intimidating to women and children. Further, each variety of equipment is comprised of an independent design, and it is usually necessary to have a completely separate piece of equipment for each strength and conditioning station.

Therefore, it is a principal object of this invention to provide a body strength and conditioning frame structure which provides a basic frame upon which many types of different conditioning equipment can be mounted.

A further object of this invention is to provide a body strength and conditioning frame structure that can be converted from one type of conditioning device to another with a minimum of mechanical manipulation.

A still further object of this invention is to provide a body strength and conditioning frame structure that can be easily adjusted and utilized by children and adult persons of slight stature.

A still further object of this invention is to provide a body strength and conditioning frame structure which is safe to use and adjust even by children.

A still further object of this invention is to provide a body strength and conditioning frame structure that can be used by both children and adults.

These and other objects will be apparent to those skilled in the art.

SUMMARY OF THE INVENTION

The present invention comprises a basic horizontal U-shaped frame structure upon which is mounted an upper frame comprised of two parallel sides connected at the top by a cross member. A vertical post or tube is secured to the base frame between the parallel sides, and extends upwardly to slidably receive the vertical portion of a T-shaped frame which is journaled in a slide mechanism on the inner face of each of the sides of the upper frame.

A plurality of parallel rods extend outwardly from the vertical member of the T-shaped frame, and these rods are spaced from, but in alignment with similar rods that extend horizontally inwardly from the inner face of the two sides of the upper frame. Weight members having center apertures are slidably mounted on these rods, and they can be moved back and forth between aligned rods by reason of having a horizontal thickness greater than the space between aligned rods.

The above-described basic frame is adaptable to having a variety of conditioning equipment mounted thereon. A particular mechanism is shown which has an arm lifting bar secured to the upper portion of the T-shaped frame. A seat portion is secured to the horizontal base frame. The bar secured to the upper portion of the T-shaped frame has hand gripping portions comprised of two spaced-apart inclined U-shaped members each having an upper horizontal gripping portion and lower horizontal gripping portion. Persons of small stature utilize the lower gripping portions, whereas taller persons are able to utilize the upper gripping portions.

DESCRIPTION OF THE PREFERRED EMBODIMENT

Figure 7:
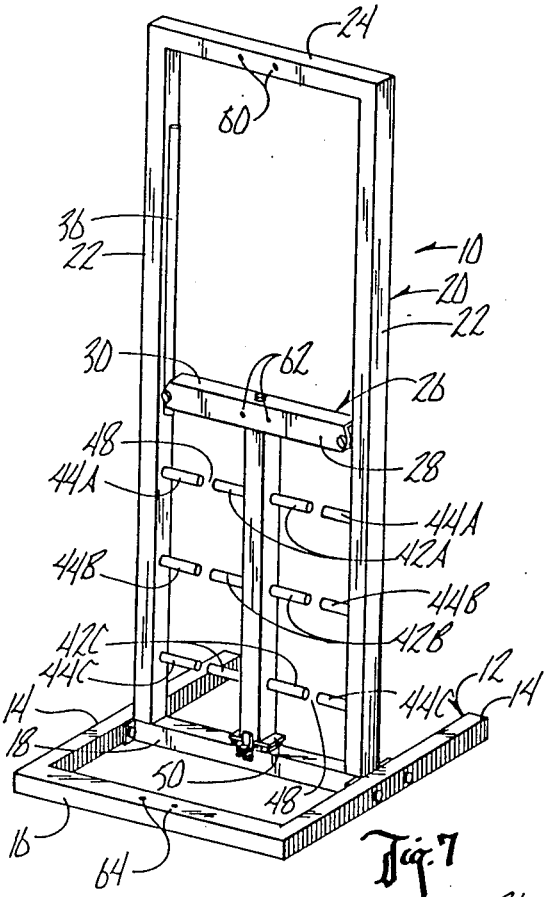
FIG. 7 is a perspective view of the basic frame structure.

The numberal 10 designates the basic frame of this invention which is best shown in its entirety in FIG. 7. Frame 10 is comprised of a horizontal U-shaped base frame 12 which is comprised of two sides 14, a front 16, and a cross member 18. This frame is normally of welded construction and is comprised of square tubing material.

An upper frame 20 is rigidly secured in any convenient manner to the ends of cross member 18 of base frame 12. Upper frame 20 is comprised of parallel sides 22 which are rigidly connected at the top ends thereof by top member 24.

Figure 6:
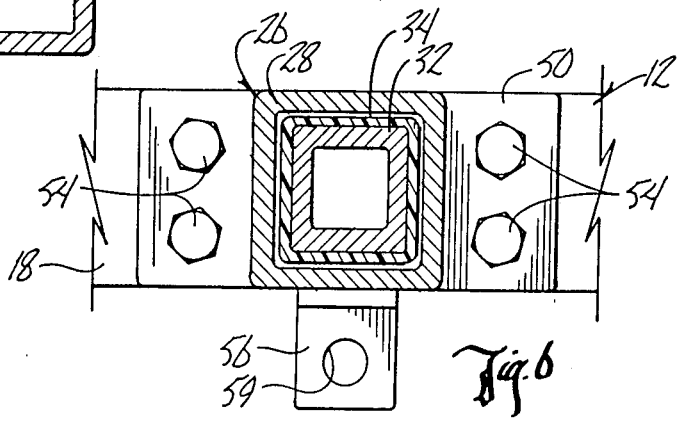
FIG. 6 has an enlarged sectional view taken on line 6—6 of FIG. 4.

T-frame 26 is movably mounted within the plane of sides 22 of upper frame 20. T-frame 26 is comprised of a hollow vertical square tube 28 which is rigidly secured to a horizontal top member 30. A vertical square tube 32 (best shown in FIG. 6) is rigidly secured to the center of cross member 18 of base frame 12 and slidably extends into hollow tube 28 of T-frame 26. Vertical tube 32 is preferably covered with a smooth material such as plastic layer 34 to reduce slidable friction with tube 28.

Vertical rods 36 are rigidly secured in any convenient manner to the upper and inner faces of sides 22 of upper frame 20. These rods are best shown in FIGS. 1, 5, 7, and 8. Rollers 38 (see FIG. 5) are secured to the opposite ends of top member 30 of T-frame 26 by means of nut, bolt and washer assemblies 40.

As best shown in FIG. 7, horizointal rods **42*a*, 42*b* and 42*c* are welded or otherwise rigidly secured to tube 28 of T-frame 26 and extend horizontally outwardly therefrom almost one-half distance towards the sides 22 of the upper frame 20. Similarly, horizontal rods 44*a*, 44*b* and 44*c* are rigidly secured to the inner face of sides 22 and are in alignment with the horizontal rods 42*a*, 42*b* and 42*c*, respectively, when the T-shaped frame is in the lower position shown in FIG. 7**.

Figure 8:
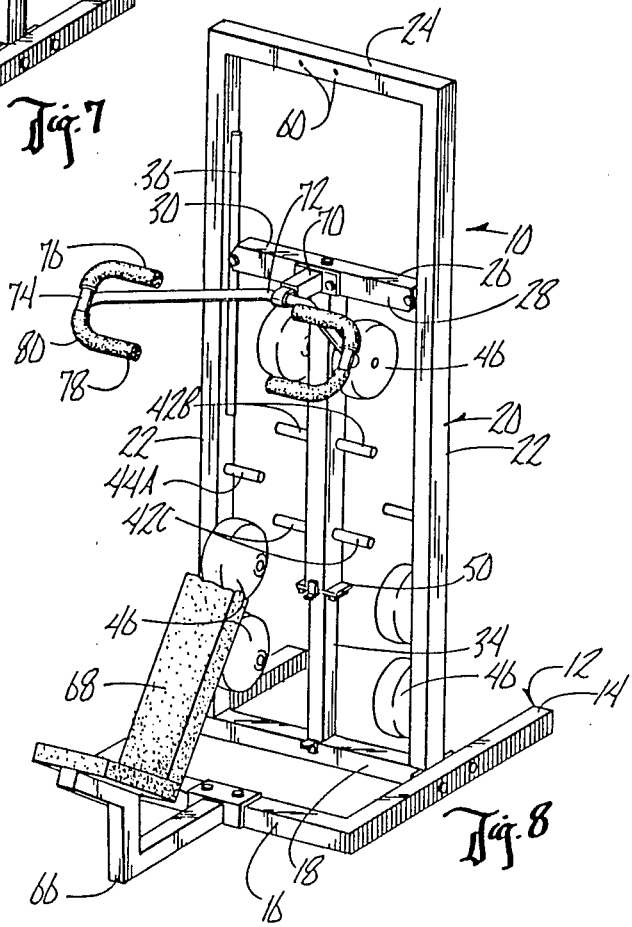
FIG. 8 is a perspective view similar to that of FIG. 1 but showing the T-shaped frame in a raised condition.

Weights 46 have a center aperture (not shown) which is just slightly larger than the diameter of the aforementioned rods, and can be slidably mounted on these rods. The weights 46 have a horizontal width greater than the space 48 which exists between the opposite ends of the above-described rods. Thus, with the rods in position of alignment as shown in FIG. 7, the weights can be slidably moved from the rods 44 to the rods 42, and visa versa, without fully removing the weights from either of the rods. If it is necessary to remove a weight from any given rod, this can be done when the positions of the normally aligned rods are in a condition of disalignment as shown in FIG. 8.

Figure 2:
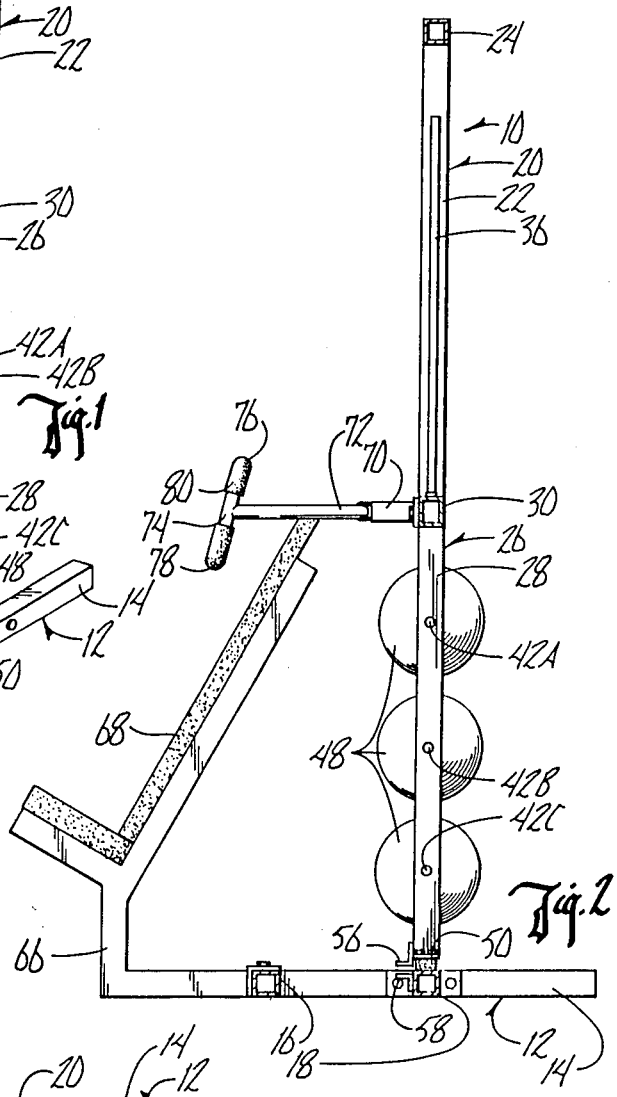
FIG. 2 is a sectional view of the device of FIG. 1 taken at an enlarged scale and taken online 2—2 of FIG. 1.
Figure 3:
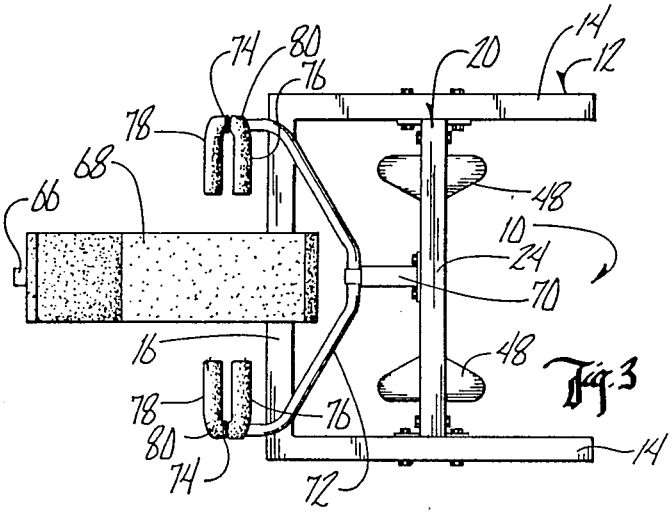
FIG. 3 is a top plan view thereof.
Figure 4:
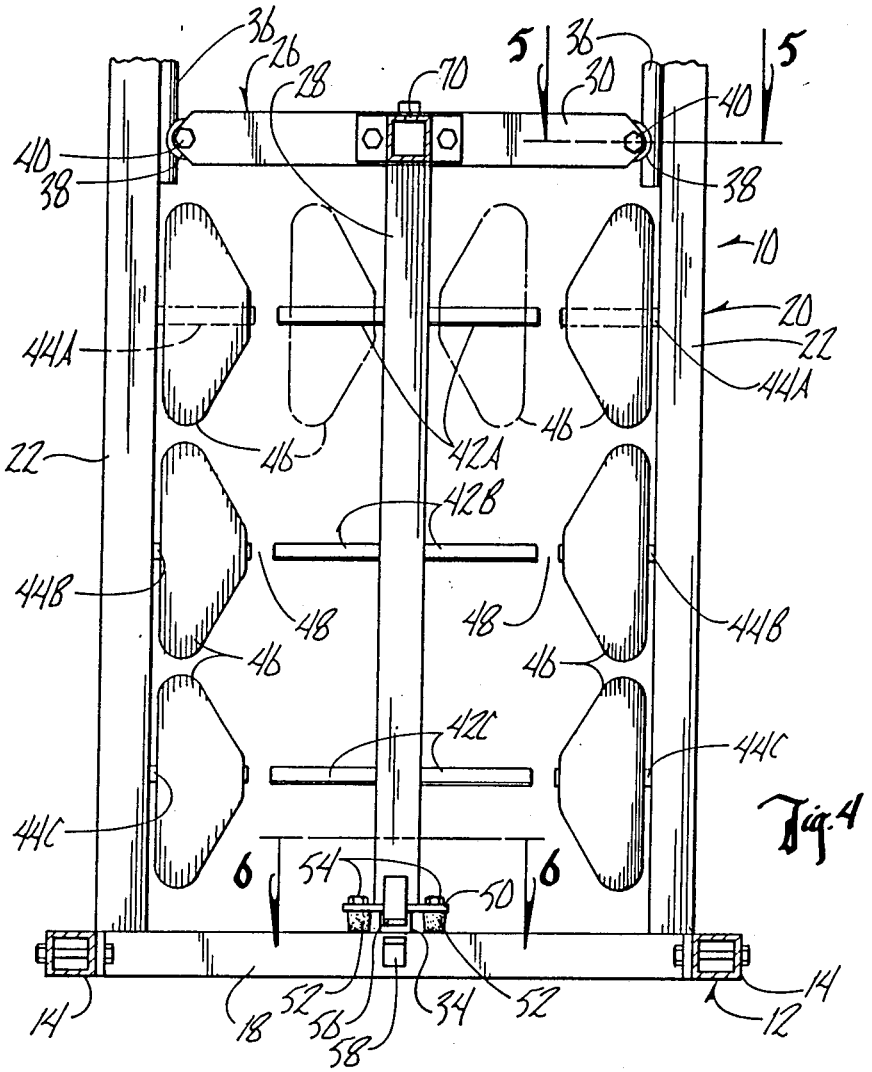
FIG. 4 is a partial front sectional view taken at an enlarged scale and shows the details of the T-shaped frame.
Figure 5:
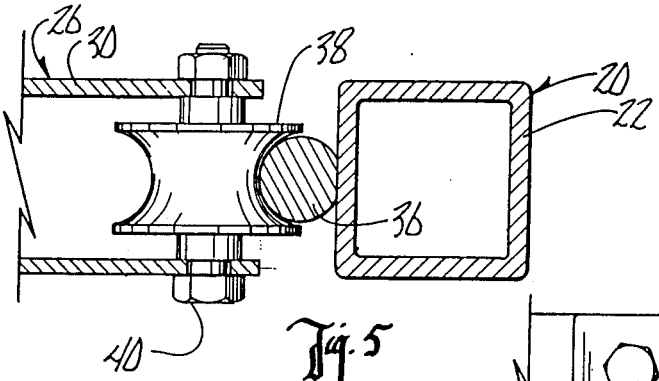
FIG. 5 is a sectional view at an enlarged scale taken on line 5—5 of FIG. 4.

As best shown in FIG. 4, a bottom plate 50 is welded or otherwise secured to the bottom of tube 28. A pair of rubber cushion elements 52 are secured to the bottom face of the plate by means of bolt means 54. As shown in FIG. 2, an upper clevis element 56 with an aperture therein is welded to the front side of the lower end of tube 28, and registers with a lower clevis element 58 which is welded or otherwise secured to the front center portion of cross member 18 of base member 12. A padlock or the like can be extended through the registering apertures 59 (FIG. 6) to lock the T-shaped frame in its lower position when not in use.

Apertures 60 are located in the upper center portion of top member 24 of upper frame 20 to permit the attachment of various conditioning equipment. Similarly, apertures 62 are located (FIG. 7) in top member 30 of T-shaped frame 26 for the same purpose. Apertures 64 are similarly located in the center portion 16 of base frame 12.

Figure 1:
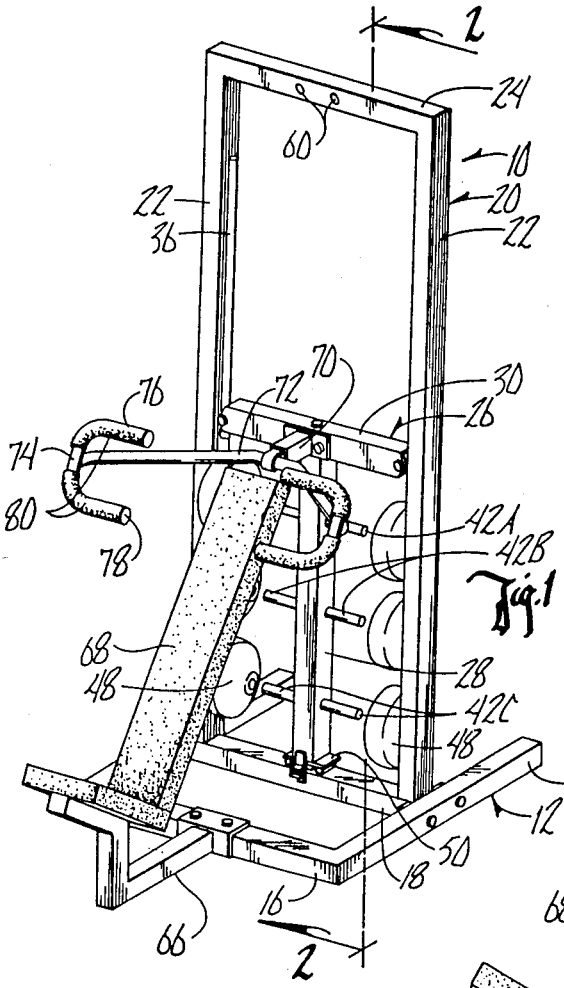
FIG. 1 is a perspective view of the basic frame of this invention with a specific conditioning apparatus mounted thereon.

With reference to FIGS. 1 and 2, a seat frame 6 can be bolted or otherwise secured to the base frame 12 by utilizing the apertures 64. Frame 12 can include an inclined seat portion 68 which will permit a person to support himself in a sitting position with his back to the upper frame 20.

A bar support 70 is mounted by utilizing the apertures 62 in upper member 30 of T-shaped frame 26. A horizontally disposed V-shaped bar 72 is mounted in bar 70. The opposite ends of bar 72 terminate in an inclined U-shaped member 74 comprised of an upper gripping horizontal portion 76 and a lower horizontal gripping portion 78. Gripping elements 80 can be secured to each of the members 76 and 78.

In the normal operation of this invention, the operator can slide any combination of weights from the storage position on rods 44*a*, 44*b*, and 44*c* to the operating position on rods 42*a*, 42*b* and 42*c*. The alternate position of weights 46 is best shown in FIG. 4, and in FIG. 8.

The operator can then sit in seat portion 68. Depending upon his or her stature, the hands can be extended upwardly to grip either the lower gripping portions 78 or the upper gripping portions 76. This enables the operator then to lift the T-shaped frame 26 to an elevated position on rods 36. The plastic coating material 34 on the vertical tube 32, as well as the rollers 38 acting in conjunction with the rods 36 reduces the friction of related components.

By utilizing the aptertures 60, 62 and 64, a wide variety of exercising and conditioning equipment can be adapted to the basic frame.

It is, therefore, seen that the device of this invention can be used by children and persons of slight stature. The weights imposed on the T-shaped frame 26 can be easily adjusted even by children without danger of injury. The rubber cushions 52 function with the plastic layer 34 and the rollers 38 to make the device operate quietly.

It is, therefore, seen that the device of this invention accomplishes at least all of its stated objectives.

I claim:

1. A basic frame adaptable for use with a plurality of strength and conditioning devices, comprising, a base support, a pair of vertical parallel spaced posts secured by the lower ends to said base support and connected by their upper ends to a horizontal cross member;

a movable T-shaped frame comprising a vertical hollow tube and a horizontal cross bar secured to the upper end of said tube;

means for guiding the movement of the opposite ends of said cross bar along said posts; and a stationary post rigidly secured to said base support and said tube slidably extending over said post.

2. The device of claim 1 wherein said means for guiding the movement of the opposite ends of said cross bar includes elongated slide bars secured to said posts and engagement means on the ends of said cross bar for engaged tracking along said slide bars.

3. The device of claim 2 wherein said engagement means includes guide wheels mounted on the ends of said cross bar and rollingly engaging said guide rods.

4. The device of claim 1 wherein weight receiving means are secured to said slide frame for detachably receiving weight means to permit the total weight of said slide frame to be selectively varied.

5. A basic frame adaptable for use with a plurality of strength and conditioning devices, comprising, a base support, a pair of vertical parallel spaced posts secured by the lower ends to said base support and connected by their upper ends to a horizontal cross member;

a T-shaped slide frame comprising a vertical hollow tube and a horizontal cross bar secured to the upper end of said tube and having opposite ends slidably engaging elongated guide rods secured to said posts; and a stationary post rigidly secured to said base support and slidably extending upwardly into said tube.

6. The device of claim 5 wherein weight receiving means are secured to said slide frame for detachably receiving weight means to permit the total weight of said slide frame to be selectively varied.

7. The device of claim 6 wherein said weight receiving means are spaced horizontal rods extending outwardly from said hollow tube.

8. The device of claim 7 wherein said weight receiving means are spaced horizontal rods extending outwardly from said hollow tube in a direction towards said posts.

9. The device of claim 8 wherein a plurality of horizontal rods are secured to said posts and are spaced from and in axial alignment with the horizontal rods on said hollow tube.

10. The device of claim 9 wherein weight members having horizontal apertures are mounted on the horizontal rods secured to said posts, with the horizontal width of said weight members being greater than the distance between the rods on said post members and the rods on said hollow tube so that said weight members can be slidably moved in a horizontal direction to assume a supporting position on said rods extending outwardly from said hollow tube.

11. The device of claim 5 wherein said stationary post is substantially covered with a friction reducing material.

12. The device of claim 11 wherein said material is plastic.

13. The device of claim 5 wherein and guide wheels are mounted on the opposite ends of said horizontal cross bar and rotatably engage said guide rods.

14. The device of claim 5 wherein a resilient stop means is secured to the bottom of said hollow tube to cushion and quiet the downward engagement of the lower end of said hollow tube with said base support.

15. The device of claim 5 wherein means are secured to said frame for selectively rigidly attaching said T-shaped slide frame to said base support.

16. The device of claim 5 wherein lifting means is secured to said frame for selectively manually raising and lowering said frame with respect to said posts and said base support.

17. The device of claim 5 wherein a locking means is secured to said frame;

comprising an L-shaped means attached to the bottom of said vertical tube and another L-shaped means attached to said inner base;

each said L-shaped member containing a hole in one leg of the L; and said L-shaped means positioned so that said holes are aligned whereby a device may be slipped through said holes to prevent movement of said T-shaped member.

18. The device of claim 16 wherein said lifting means comprises a pair of spaced arms secured to said slide frame and extending outwardly therefrom, each of said arms having outer ends, a horizontally disposed U-shaped member secured to said ends and comprising an upper and lower horizontal bar to provide alternate vertically spaced manual gripping portions.

* * * * *